US005086697A

United States Patent [19]

Koper et al.

[11] Patent Number: 5,086,697

[45] Date of Patent: Feb. 11, 1992

[54] INKED RIBBON CARTRIDGE FOR MONEY ORDER IMPRINTER

[75] Inventors: Robert P. Koper, Bensenville; Howard R. Konieczka, Chicago, both of Ill.

[73] Assignee: The Paymaster Corporation, Chicago, Ill.

[21] Appl. No.: 622,928

[22] Filed: Dec. 6, 1990

Related U.S. Application Data

[62] Division of Ser. No. 418,670, Oct. 10, 1989, Pat. No. 4,995,315.

[51] Int. Cl.[5] ..... B41F 1/04; B41J 1/58

[52] U.S. Cl. ..... 101/336; 400/240.2

[58] Field of Search ..... 101/336; 400/240.2

[56] References Cited

U.S. PATENT DOCUMENTS

| | | | |
|---|---|---|---|
| 385,391 | 7/1888 | Underwood et al. | 101/336 X |
| 1,364,788 | 1/1921 | Neidich | 400/240.2 X |
| 1,410,357 | 3/1922 | Adams | 101/336 |
| 3,916,788 | 11/1975 | Rodriguez | 101/336 X |
| 3,952,649 | 4/1976 | Dikoff | 101/336 X |
| 4,984,912 | 1/1991 | Findlay et al. | 400/240.2 |

FOREIGN PATENT DOCUMENTS

| | | | |
|---|---|---|---|
| 0054575 | 6/1982 | European Pat. Off. | 101/336 |
| 0083492 | 5/1982 | Japan | 400/240.2 |
| 0177386 | 10/1983 | Japan | 400/240.2 |

OTHER PUBLICATIONS

Nash et al., "Ink Barrier for a Multicolor Printer Ribbon", *IBM Tech. Disc. Bul.*, vol. 27, No. 3, p. 1824, Aug. 1984.

*Primary Examiner*—Clifford D. Crowder

*Attorney, Agent, or Firm*—Emrich & Dithmar

[57] ABSTRACT

An imprinting apparatus for imprinting checks, money orders and like negotiable instruments includes adjustable type segment members having type characters thereon for printing the dollar and cents amount of the money order in conventional Arabic characters and in characters which are readable by an optical character recognition device, the apparatus including two platen assemblies operated by a common operating lever to simutaneously imprint the money order with both conventional Arabic and optical character readable information, one of the platen assemblies being operable to effect impact movement of an associated platen in imprinting the form. The apparatus employs a replaceable inked ribbon cartridge including a ribbon bearing a dye-based ink which permeates the money order from front to back as a deterrent to alteration of a dollar amount imprinted thereon.

8 Claims, 8 Drawing Sheets

10

FIG. 7
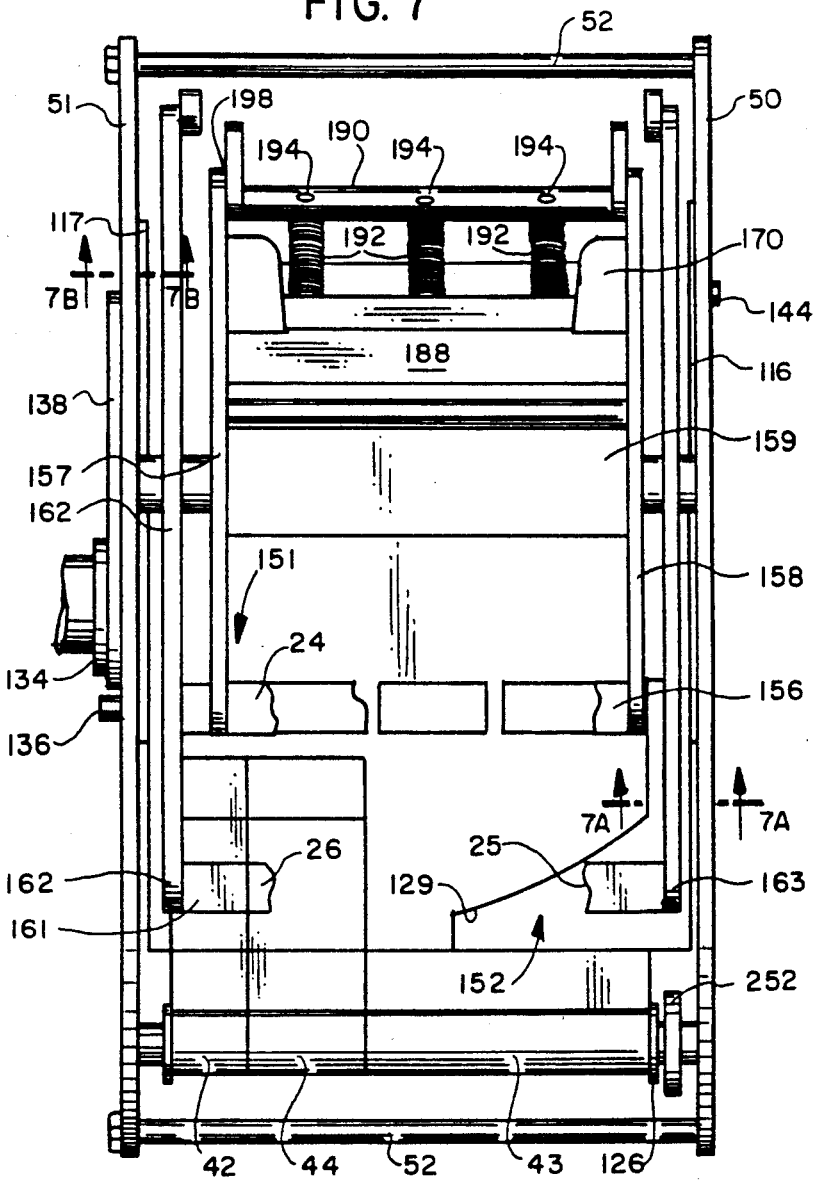
FIG. 7B
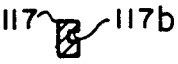
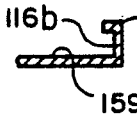
FIG. 7A
FIG. 8
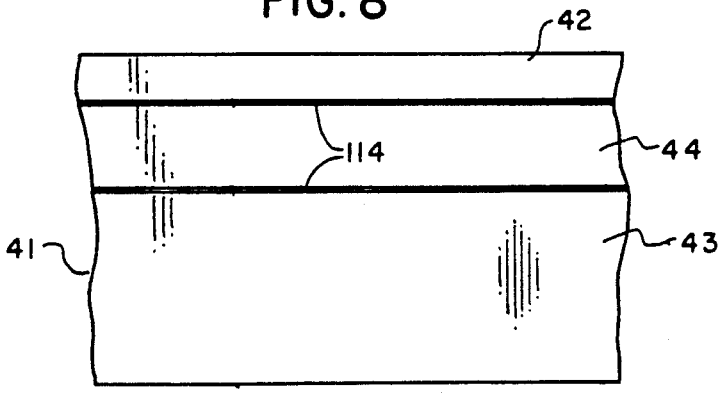

INKED RIBBON CARTRIDGE FOR MONEY ORDER IMPRINTER

This is a division of application Ser. No. 07/418,670, filed Oct. 10, 1989, now U.S. Pat. No. 4,995,315.

BACKGROUND OF THE INVENTION

This invention relates to apparatus for imprinting money orders, checks, and the like.

Known imprinting apparatus, commonly referred to as check writers or money order printing machines, employ type segments or printing members having printing characters thereon which are independently movable to selectively dispose any of the printing characters on a printing line preparatory to effecting printing on a blank check, money order form or analogous instrument. The blank checks or money order forms in many instances provide for imprinting of the current date and of indicia identifying the source or location of printing such as a Post Office, bank or other source as well as the dollar amount for which the check or money order is written. The date, and the dollar and cents amount are imprinted using the movable type segments whereas a fixed plate bearing indicia identifying the source is used to print that information. Thus, a special plate must be provided for each imprinting machine, and if a given machine is moved to a different location, it must be provided with a new plate bearing the necessary identifying information.

Existing check writing machines imprint the amount for which the money order is issued in conventional arabic characters so as to be easily and readily recognizable by the individual ordering the money order. As a deterrent to alterations of the dollar amount printed on the money order form, a perforating plate or the like is used to provide serrations in the money order form where the dollar amount is printed. Processing these money orders or checks requires manual handling, including manual data entry on keypunching to print the dollar and cents amount on the money order or check in a suitable format for automatic processing by banking institutions, typically by optical character recognition apparatus. Thus, it would be desirable if the information indicating the dollar and cents amount of the money order or check were imprinted on the form both in conventional arabic numerals and in characters which are optically readable by character recognition apparatus.

Moreover, it would be desirable also to have a checkwriter, which produces high quality imprinted documents suitable for use on high speed optical character recognition equipment and which provide security of the imprinted dollar amount that is equal to or better than the standard checkwriter practices acceptable to banking institutions.

Checkwriting machines presently available employ reel-to-reel inked ribbons for inking the printing wheels. The inked ribbons must be changed frequently. This requires threading the leading portion of the inked ribbon passed the printing mechanism and winding it onto the take-up reel, which can be a difficult and messy task. Also, because a portion of the inked ribbon is exposed within the unit, a person servicing the machine may accidentally contact the inked roller with their hand or fingers. Thus, it would be desirable to have a checkwriter apparatus which eliminates the inconveniences associated with the use of reel-to-reel inked ribbons in checkwriters.

A further consideration is that blank instruments of different sizes are frequently used. Also, in the case of postal money orders, the size of the money order form is changed form time to time. Therefore, it would be desirable to have a checkwriter apparatus which readily adapts to blank instruments of different sizes and shapes.

SUMMARY OF THE INVENTION

The present invention provides an imprinting apparatus for printing money orders and like instruments, comprising a frame, a plurality of type segment members supported by the frame and at least certain ones of said type-segment members having first and second sets of printing characters, said type segment members being movable to locate printing characters of said first and second sets on first and second printing lines, respectively, an inked ribbon and ribbon support means supporting said ribbon adjacent to printing characters disposed on the first and second printing lines, platen means supported by the frame and including a first platen adapted for cooperation with printing characters of the first set and a second platen adapted for cooperation with printing characters of the second set, actuating means supported by the frame and including an operating lever having a normal non-printing position and being movable to a printing position for effecting a printing operation, means coupled to the operating lever for moving the first and second platens into pressure contact with an instrument disposed between the platen means and printing characters disposed on the printing lines, said means for moving including a first mechanism coupled to the first platen for moving same into pressure contact with the instrument and printing characters on the first printing line, and a second mechanism coupled to the second platen and operable independently of the first mechanism to effect impact movement of said second platen into pressure contact with the instrument and printing characters on the second printing line, and said means for moving the first and second platens being adapted to return the first and second platens to their normal position in the return movement of the operating lever to its normal position.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

FIG. 7 is a fragmentary bottom plan view of the imprinting apparatus;

FIGS. 7A and 7B are fragmentary sectional views taken along the lines 7A—7A and 7B—7B of FIG. 7;

FIG. 8 is a fragmentary view of the inked ribbon for use with the imprinting apparatus;

DESCRIPTION OF A PREFERRED EMBODIMENT

Figure 1:
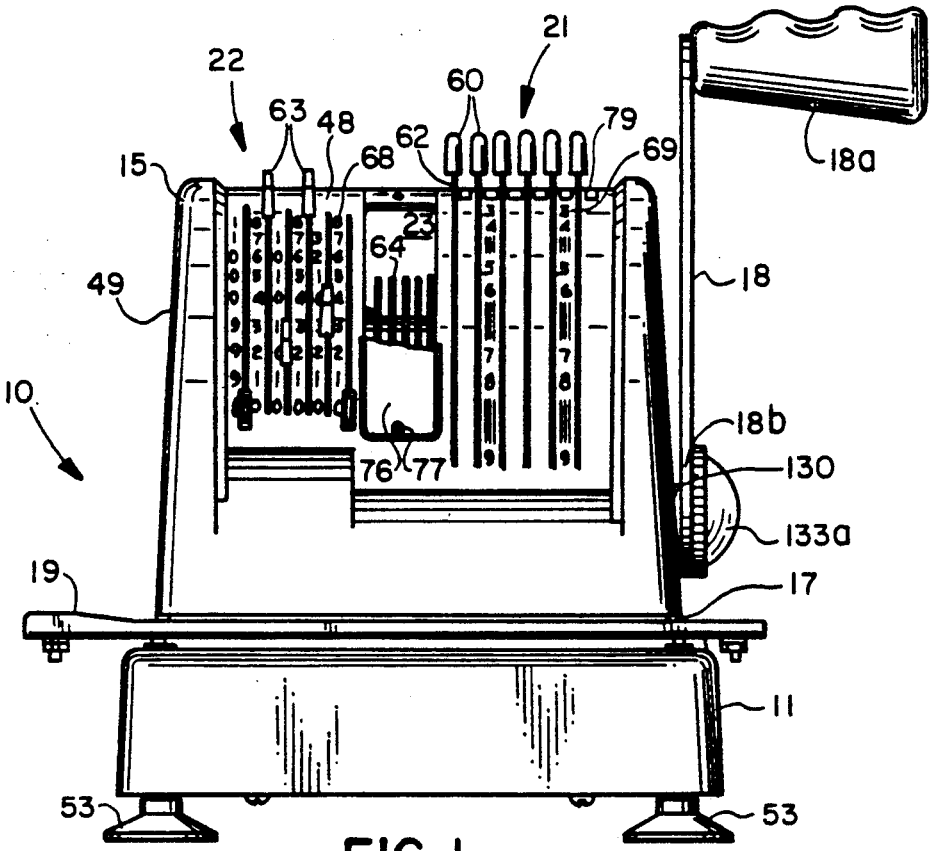
FIG. 1 is a front plan view of an imprinting apparatus provided by the present invention.

Referring to FIGS. 1-5, the present invention is illustrated in combination with an imprinting apparatus hereinafter referred to as a checkwriter, indicated generally at 10, which is used for printing checks, money orders, or other negotiable instruments. By way of illustration, the checkwriter is described with reference to an application for imprinting postal money order forms, such as form 30 illustrated in FIG. 4, with information including date of issue, issue source or location and the dollar and cents amount for which the money order is issued.

Briefly, the checkwriter 10 comprises a base 11, a frame 12 which supports a printing mechanism indicated generally at 14, a removable top case assembly 15 enclosing the frame and the printing mechanism, and a manually operable operating lever 18 which is linked to the printing mechanism 14 for effecting printing operations. The printing mechanism 14 includes three groups of type segment members 21, 22 and 23, and two platens 24 and 25 which operate independently of one another and define first and second printing lines for the checkwriter. The base 11 supports an adjustable form guide 19 which locates a money order form 30 (FIG. 4) to be imprinted in alignment with print lines defined by the platens of the printing mechanism 14.

Preferably, the form is a multiple copy form including the original check or money order, a voucher, and a customer copy.

As will be described, the checkwriter 10 imprints on the form 30 (FIG. 4) date information, issuing source or location information, such as the zip code, and the dollar and cents amount for which the money order is drawn in a format which is readable by optical character recognition (OCR) apparatus. In addition, the checkwriter apparatus imprints the dollar and cents amount information on the form in conventional arabic numerals. As illustrated in FIG. 4, the date, source or location and OCR dollar amount information are printed on one line in three fields 31, 32 and 33. The checkwriter amount is imprinted on the form in arabic numerals in a fourth field 34 located adjacent, to but on a separate line, from the OCR information 33. The information is imprinted in all four fields with a single stroke of the operating lever 18. Referring to FIGS. 1-5 each group of type segment members 21, 22, and 23 includes six type segment members 21*a*-21*f*, 22*a*-22*f* and 23*a*-23*f*, respectively, which are individually movable to position along printing lines of the checkwriter, providing up to six digits or characters for each set of information. The information in the three fields 31-33 is imprinted using an impact mechanism by which a potential energy means stores energy which is transferred to the platen 24 near the end of the stroke of the operating lever 18 during a printing operation. The impact mechanism assures high quality optical character recognition on the carbon voucher of the multiple copy money order form. The platen 25 includes serrations which perforate the form in imprinting the dollar amount information in field 34.

In accordance with another feature of the invention, the inked ribbon 41 includes a durable dye-base ink, on a nylon fabric ribbon to imprint a secure checkwriter impression in field 34 on the face of the negotiable document or form. The checkwriter 10 includes a cartridge 40 containing the inked ribbon 41 (FIGS. 7-9), the cartridge 40 being insertable into the checkwriter unit and being guided along a path defined by guide rails 116 and 117 (FIG. 7) to interpose the inked ribbon 41 between the type segment members 21-23 and the platens 24 and 25, as shown for example in FIG. 2. For the purpose of providing security of the imprinted money order dollar amount, the inked ribbon includes at least in part, a dye-based ink which permeates the paper form. The inked ribbon includes segments of conventional pigment-based ink on longitudinal portions 42 and 43 thereof and a dye-based ink 44 along a longitudinal portion thereof intermediate portions 42 and 43. The dye-based ink is used in imprinting the digits in fields 33 and 34 (FIG. 4) indicating the dollar amount on the form whereas the conventional pigment-based ink is used in imprinting the digits in fields 31-34 (FIG. 4) indicating the cents amount and the other information on the form. The dye-based ink is absorbed into the paper, permeating from the upper to lower surface of the form, and thus appearing on the lower surface of the form albeit in mirror image. This in addition to the perforated image of the dollar amount information serves as a deterrent to alteration of the dollar amount imprinted on a money order form. In accordance with a further feature of the invention, the form 30 (FIG. 4) is a multiple copy form, including sheets 30*a*, 30*b*, 30*c*, for example, at least the top sheet 30*a* of which is made of an absorbing type paper which enhances the permeation of the dye based ink from the upper to lower surfaces of the form top sheet.

Considering the checkwriter 10 in more detail with reference to FIGS. 1–5, the frame 12 includes upstanding side plates 50 and 51 secured together in parallel spaced relation by cross rods 52 in a known manner. The side plates 50 and 51 are of irregular polygonal shape and are provided with forwardly extending base elements which define with the upper portions the rearwardly extending slot 17 which receives the postal money order form 30, blank or analogous instrument to be printed upon, as is known. The enclosing top case assembly 15 is conventionally adapted to be secured to the checkwriter frame 12 in a suitable manner. The casing assembly 15 which encloses the frame structure 12 and working elements of the checkwriter, includes a face plate 48 and a cover 49. The lower portion of the cover 49 encloses the side plate portions above the slot 17 and the base which defines a support platform on which the form guide 19 is mounted (FIG. 3) to support the forms 30 during insertion into the slot for printing. The base 11 is equipped with suction cups 53 or the equivalent so that the unit is stable when used.

Referring to FIGS. 1–3 and 5, a cross-shaft 54 is mounted on and between the spaced side plates 50 and 51 by means of reduced studs (not shown) at its opposite ends providing shoulders abutting the inner faces of the side plates and restraining the cross-shaft against endwise movement. The type segment members 21*a*–21*f*, 22*a*–22*f*, and 23*a*–23*f* are mounted upon the cross-shaft 54 for individual rotation or turning movement thereon and are maintained in spaced relation on the shaft by suitable spacing collars in a known manner. The type segment members of groups 21 and 22 each include a disc shaped element, such as element 55 for type segment 21*a* shown in FIG. 6, with an arcuate-type bar, such as type bar 56 for type segment member 21*a* having upon its peripheral edge or printing face 57 a series of printing characters 59 selectively positionable through a finger grip 60, carried by an extension 61, in the manner known in the art, operatively associated with the type segment member, and extending through a slot 62 in the face plate 48, to position the printing characters on a printing line of the checkwriter as will be more fully described hereinbelow. Similarly, the type segment members of set 23 include an arcuate type bar (not shown) having upon its peripheral printing face a series of printing characters selectively positionable through extensions 64 accessible through a removable access door 76 secured to the face plate 48 by screws 77.

Figure 6:
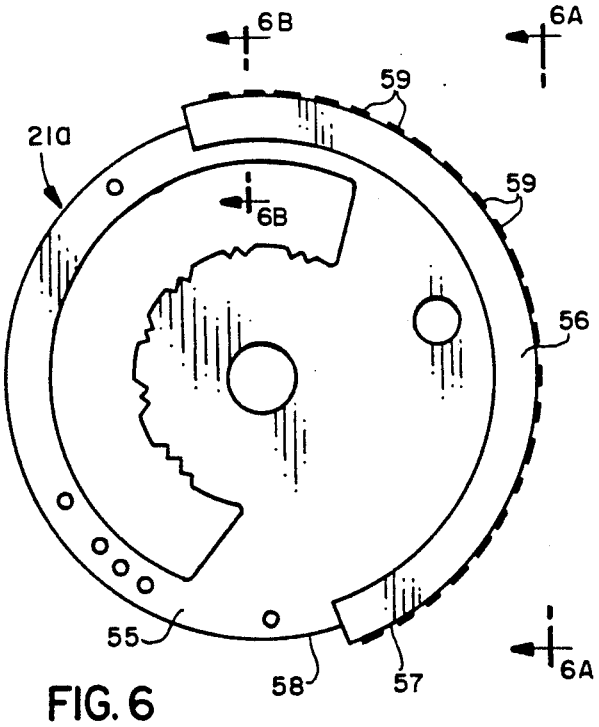
FIG. 6 is a plan view of a print wheel.
Figure 6A:
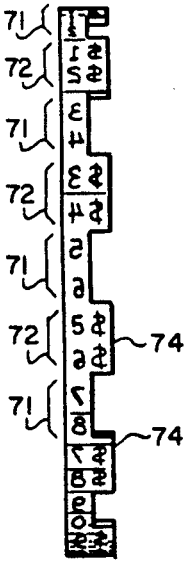
FIG. 6A is an end view taken along the line 6A—6A of FIG. 6.
Figure 6B:
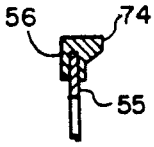
FIG. 6B is a fragmentary sectional view taken along the line 6B—6B of FIG. 6.

Referring to FIGS. 6, 6A and 6B, the type segment member 21*a* comprises a circular support element 55 having the arcuate type bar 56 secured to the peripheral edge 58 of the support member and having a printing face 57 with two sets 71, 72 of type characters spaced therealong. The characters of one set 71 of type characters are interposed in pairs between characters of the other characters set 72. The character set 72 includes numbers in a conventional arabic checkwriting format and other indicia such as dollar signs ($) and asterisks (*). The other set of type characters 71 includes numbers in a format readable by optical character recognition apparatus. As shown in FIG. 6A, each pair of OCR number characters precedes its pair of conventional serrated arabic checkwriter number characters. That is, the OCR type for numbers 3,4 are interposed between numbers 1,2 and 3,4 in conventional arabic format. Next, OCR numbers 5,6 are disposed between checkwriter numbers 5,6 and 7,8 etc. This results in a two-line spacing between each OCR number and its corresponding checkwriter number as imprinted on a form. With this arrangement, the same manual setting of the OCR amount characters simultaneously sets the checkwriter amount characters.

The type bar 21*a* includes laterally projecting segments 74 adjacent to the type characters in conventional checkwriter format which carry the dollar sign type ($) for indicia to be imprinted on the instrument.

Referring to FIG. 1, the rightmost group 21 of six type segment members comprise the dollar and cents printing characters, while the leftmost group 22 of type segment members comprise printing characters for printing date information. The intermediate group 23 of type segments provide information for printing the source or location identifying serial number or like information on the form. In the exemplary embodiment, wherein the form to be imprinted is a postal money order, the identifying serial number is the zip code. The number of type segment members selected for use in the checkwriter 10 may be varied as desired, the number of type segment members employed having no bearing upon the present invention.

The finger grips 63 used to position the date segments 22 extend through the face plate 48 of the checkwriter and are quickly referenced to locating digits 68 on the face plate 48. Fully adjustable type segments 23 accomplish the zip code plus 1 digit registration. The zip code type segments 23 are located under the face of the checkwriter concealed by an access door 76 which can easily be opened by removing the two screws 77. This allows checkwriters in accordance with the present invention to be shipped to and ready for immediate operation at any facility without the delay of producing, delivering, and installing a separate zip code identification plate.

The dollar and cents amount type segments 21 are quickly positioned and set by operating the finger grips 60 relative to the locating digits 69 on the face plate 48, and verified by a full view of the desired amount to be imprinted in the dollar and cent windows 79 ideally located near the top of the checkwriter. Both OCR, and checkwriter dollar amounts are set in one motion, and the form is imprinted with a single pull of the operating lever 18.

Figure 4:
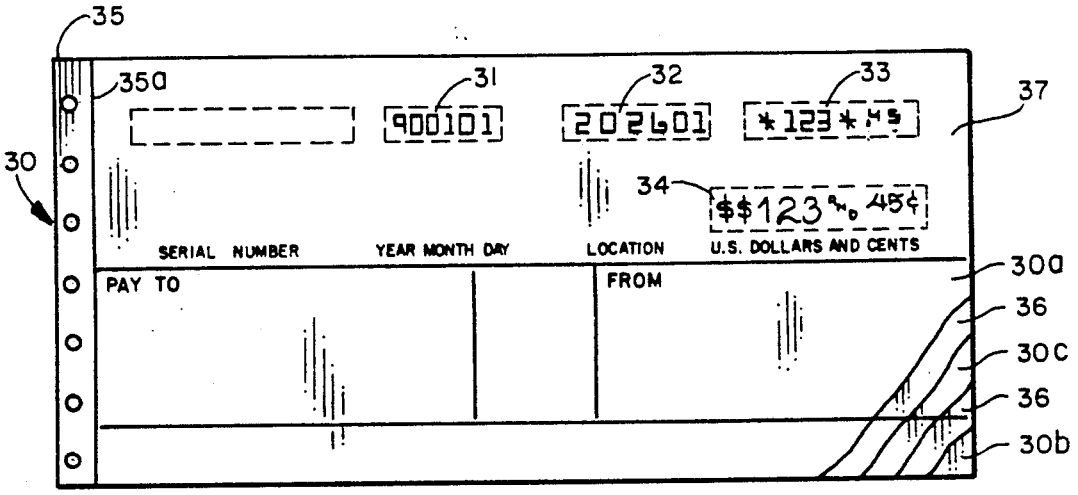
FIG. 4 is a form provided by the present invention and which is shown imprinted by the imprinting apparatus.
Figure 4A:
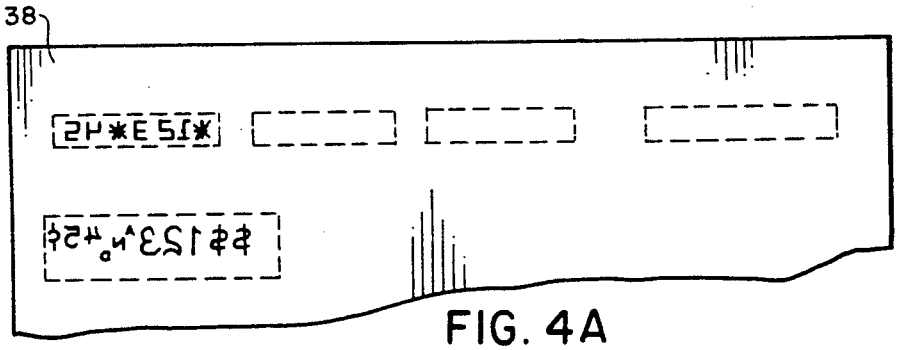
FIG. 4A is a fragmentary view of the back side of the form shown in FIG. 4.

Referring to FIGS. 4 and 4A, as indicated, the form 30 defines amount fields including a checkwriter amount field 34 for receiving indicia in a conventional checkwriting format and an amount field 33 for receiving indicia in a format which is recognizable by optical character recognition apparatus. Fields 33 and 34 or portions thereof may be of different background colors. Preferably, the dollar amounts and the cents amounts imprinted on the form are in different colored inks.

The form 30 is a multicopy form including a plurality of sheets including a top sheet 30*a* which is the original negotiable money order, a bottom sheet 30*b* which is the customer receipt, and at least one intermediate sheet 30*c*, which is the Post Office voucher, bound together along one edge 35 of the form which includes a perforation 35*a* to facilitate removal of the money order and customer receipt from the multiple copy form. Carbon paper or other transfer medium 36, is interposed between adjacent sheets of the form for duplicating on the lower and intermediate sheets an image imprinted on the top sheet. At least the uppermost carbon paper sheet in OCR waxed paper to enhance clarity around the digits imprinted thereon. The top sheet 30*a* is made of an absorbing type paper material for absorbing dye based ink. In the exemplary embodiment, top sheets 30*a* is 24# OCR bond, sheet 30*b* is 10# paper stock and sheet 30*c* is 20# OCR bond. When the form is impacted by the printing mechanism of the imprinting apparatus, the ink permeates through the top sheet from its front surface 37 to its back surface 38.

Figure 12:
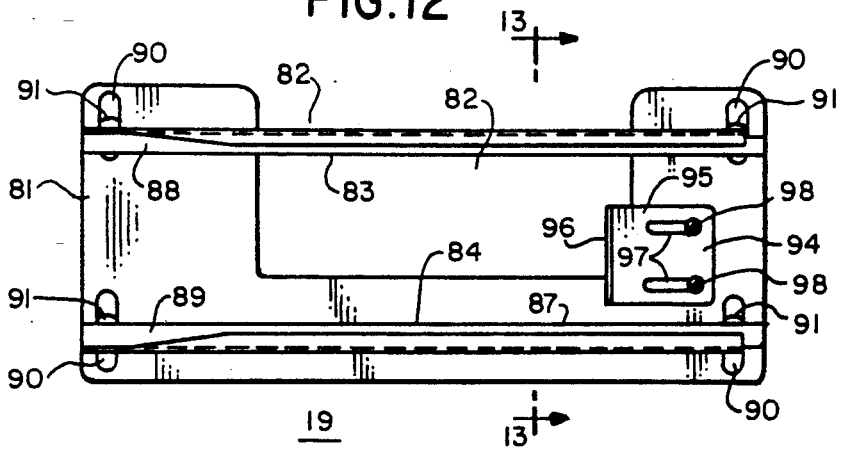
FIG. 12 is a top plan view of a check tray for the imprinting apparatus provided by the present invention.
Figure 10:
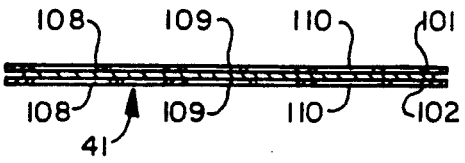
FIG. 10 is a sectional view taken along the lines 10—10 of FIG. 9.
Figure 13:
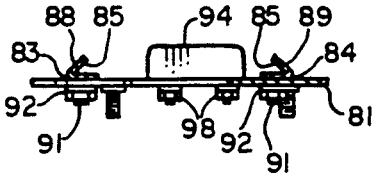
FIG. 13 is a sectional view taken along the line 13—13 of FIG. 12.

Referring to FIGS. 1, 12 and 13, the form positioning guide 19 is removably secured to the base by suitable fasteners. The form positioning guide 19 includes a rectangular base plate 81 and is provided with a substantially rectangular opening 82 which accommodates upward movement of the platens 24 and 25 (FIG. 3) incident to a printing operation. A pair of side rails 83 and 84 extend longitudinally of the base plate 81, each defining a slot or groove 85 for reception of the top and bottom edges respectively of the form 30 to be printed upon. The side rails 83 and 84 are movably mounted on the base plate by screws 91 which extend through slots 90 in the base plate and are held in place by nuts 92. As shown in FIG. 12, the side rails 83 and 84 are L-shaped, with upstanding sides 86 and 87 defining a form receiving guide and the portions 88 and 89 being bent over to extend at approximately a 45 degree angle relative to the base plate 81 defining the grooves 85 which guide the edges of the form to align the print fields with the platens.

The guide 19 further includes a stop member 94 which comprises an L-shaped element which has a base portion 95 movably mounted on the base plate 81 and a vertical portion 96 which provides a stop for the forward edge of the form as it is being inserted into the checkwriter 10. The stop member 94 has slots 97 in its base portion 95 through which pass screws 98 which are received in tapped holes in the base plate, permitting adjustment of the position of the stop member 94 lengthwise of the base plate 91.

As will be understood, the guide 19 accurately positions the money order or analogous blank in respect to the printing lines of the checkwriter. The adjustable side rails 83 and 84, and adjustable stop member 94 permit variation in the size of the form guide to adapt the guide to different size forms.

Referring to FIGS. 7–11, the cartridge 40 includes a housing having an upper housing member 101 and a lower housing member 102 constructed and arranged to be assembled and latched together by complementary latch elements 103. The upper and lower housing members when assembled together define a spool receiving chamber 104, a ribbon guide portion 105 and a throat portion 106 communicating the chamber 104 with the ribbon guide portion 105. The housing members 101 and 102 each define four rectangular windows 108, 109, 110 and 111 therethrough in the ribbon guide portion 105 thereof. Windows 108–111 are aligned to expose a portion of the ribbon 41 to the associated platen relative to the type segments.

The inked ribbon 41 is made of a four mil texturized nylon fabric which includes portions 42 and 43 bearing a pigment-based ink, and a portion 44 intermediate the portions 42 and 43 bearing a dye-based ink. The inked ribbon includes heat sealed seams 114 formed longitudinally of the ribbon, separating the first or outer portions 42 and 43 from the intermediate portion 44 to control migration of the dye-based ink into the ribbon portions bearing the pigment-based ink. The seams close off the fiber of the nylon fabric to substantially prevent migration of the dye-based ink into outer portions 42 and 43. The ribbon is wound on a spool (not shown) which is contained within the spool receiving chamber 104. By way of example, up to three yards of ribbon may be provided for a cartridge, providing for 3500 to 4000 impacts per spool.

Figure 9:
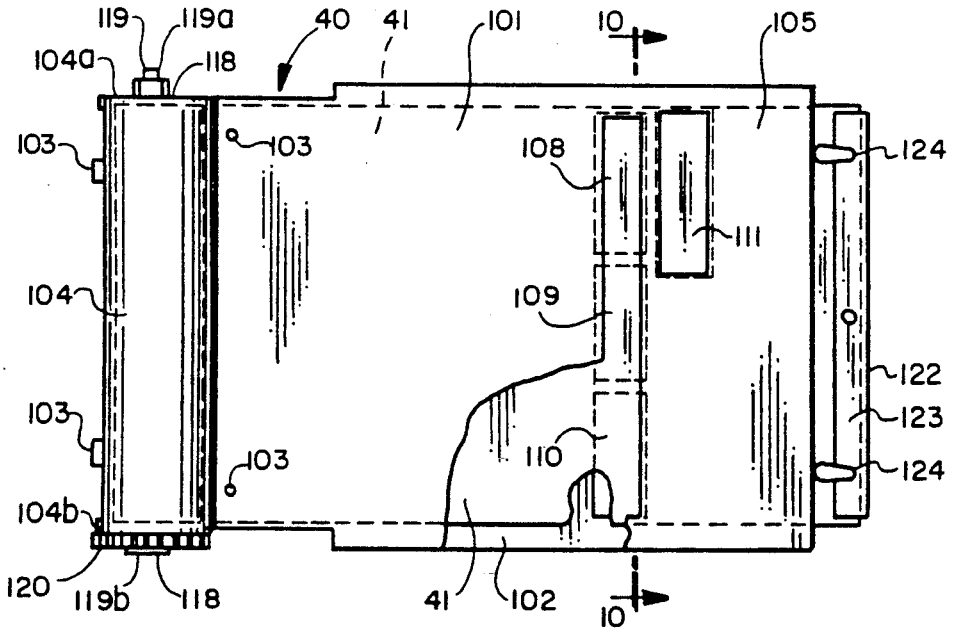
FIG. 9 is a top plan view of the ink cartridge.
Figure 11:
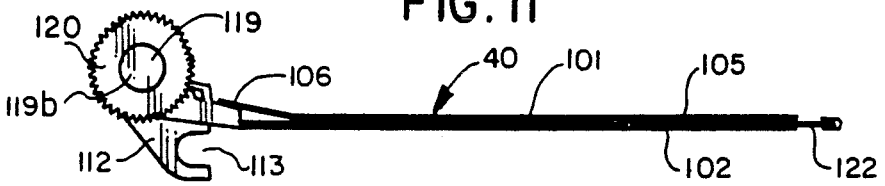
FIG. 11 is a side elevation view of the ink cartridge.

The sides 104*a* and 104*b* of the spool receiving chamber define apertures 118 through which pass the ends of the shaft 119 of the ribbon spool (not shown). One end of the shaft 119 includes a gear 120. The upper housing member 101 and lower housing member 102 are assembled together after a spool of ribbon has been inserted into the cartridge. Prior to closing the housing, the free end 122 of the ribbon is drawn off the spool to be located externally of the cartridge (FIG. 9). The free end 122 of the ribbon includes a pull tab 123 provided with a pair of slots 124 which are received on pegs (not shown) of the ribbon take-up spool 126 (FIG. 7). The take-up spool 126 is advanced by a lever 230 (FIG. 2) which is coupled to the operating lever 18 for advancing the inked ribbon 41 with each actuation of the operating lever during a printing operation.

Figure 5:
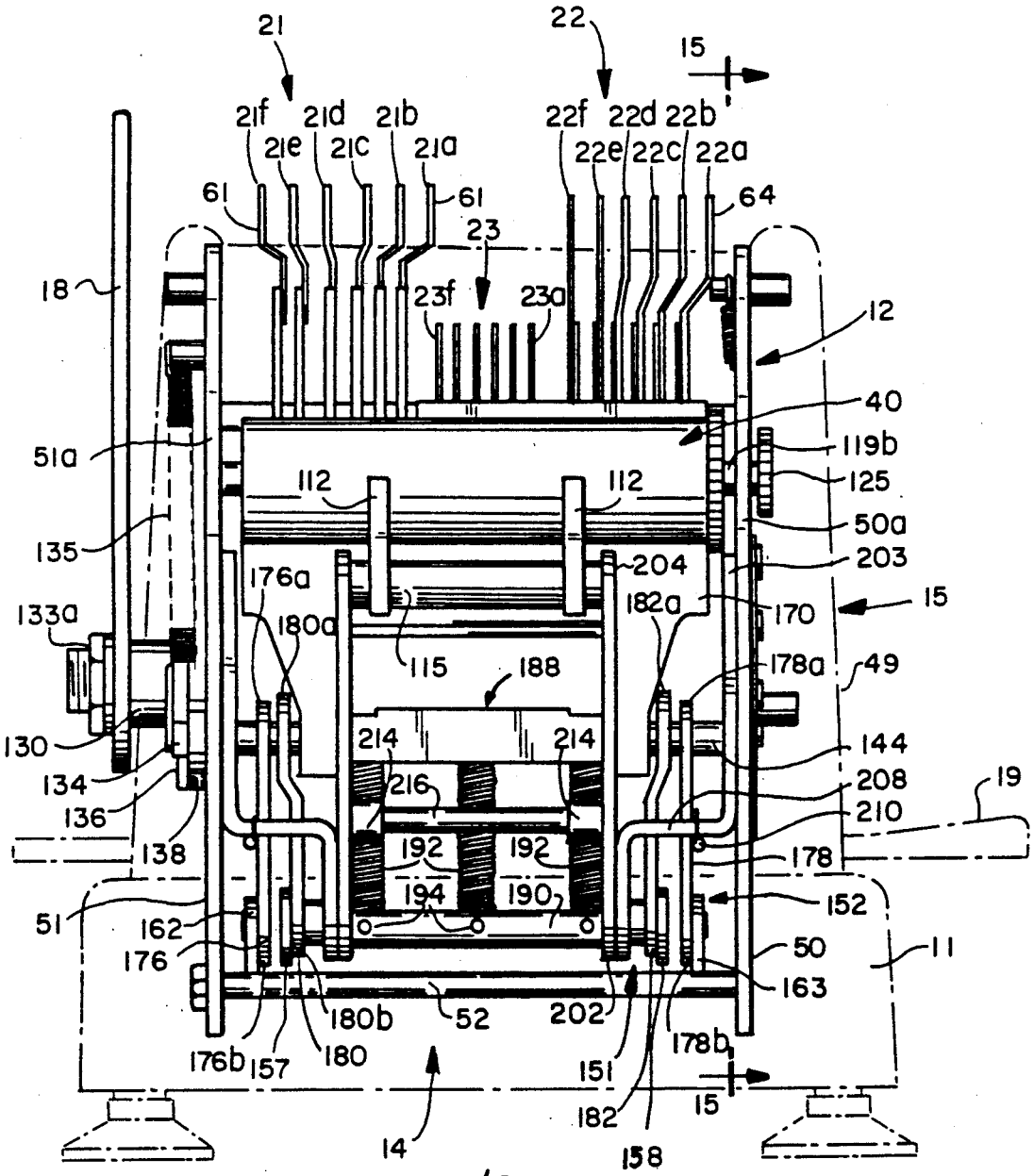
FIG. 5 is a rear elevation view of the imprinting apparatus with the frame illustrated in phantom.

For the purpose of mounting the inked ribbon cartridge 40 to the checkwriter frame the lower housing member 102 includes a pair of downwardly extending fins 112 each provided with an arcuate cutout 113 dimensioned to receive a cross shaft 115 (FIG. 5) when the cartridge is received in the checkwriter. Also one end 119*a* of spool shaft 119 is received in an aperture 51*a* in side plate 51 (FIG. 5). The other end 119*b* of the shaft 119 is counter bored and tapped and receives the threaded shaft of a screw 125 which passes through an aperture 50*a* in side plate 50, facilitating removable securing of the cartridge to the checkwriter.

The cartridge locates the ribbon 41 within the checkwriter apparatus 10 with the dye-based ink located to imprint the characters representing dollar amount in both conventional checkwriter format and OCR format. The other information including cents amount, date and source or location is printed on the form by the pigment-based ink. However, some or all of the other information may be printed on the form with a dye-based ink.

Referring to FIGS. 2, 3, 5 and 7, for the purpose of positioning the cartridge with the checkwriter, a pair of cartridge guide rails 116 and 117 are carried by the frame for supporting the cartridge within the apparatus. The guide rails 116 and 117 are arranged for guiding the cartridge into position relative to the printing lines during insertion and removal of the cartridge from the checkwriter apparatus 10. That is the windows 108–110 are located to be in line with platen 24 and window 111 is located to be in line with platen 25 when the platens are operated to their printing positions. Also, the dye-based ink portion 44 is aligned with the dollar amount type segments disposed along the two printing lines.

Guide rail 116 (FIGS. 2 and 7) is secured to the inner surface of side plate 50 by lateral projections 116*a*. Guide rail 116 comprises an elongated rail member bent at an obtuse angle, extending from a point just below the cartridge mounting to a point just before the take-up spool 126. The guide rail 116 defines an inwardly directed groove 116*b* (FIG. 7A) which receives and locates the cartridge which guides the ribbon along path to the take-up spool 126 as shown in FIG. 7. Guide rail 116 has an inwardly directed support flange 129 which supports the free end of the cartridge.

Figure 3:
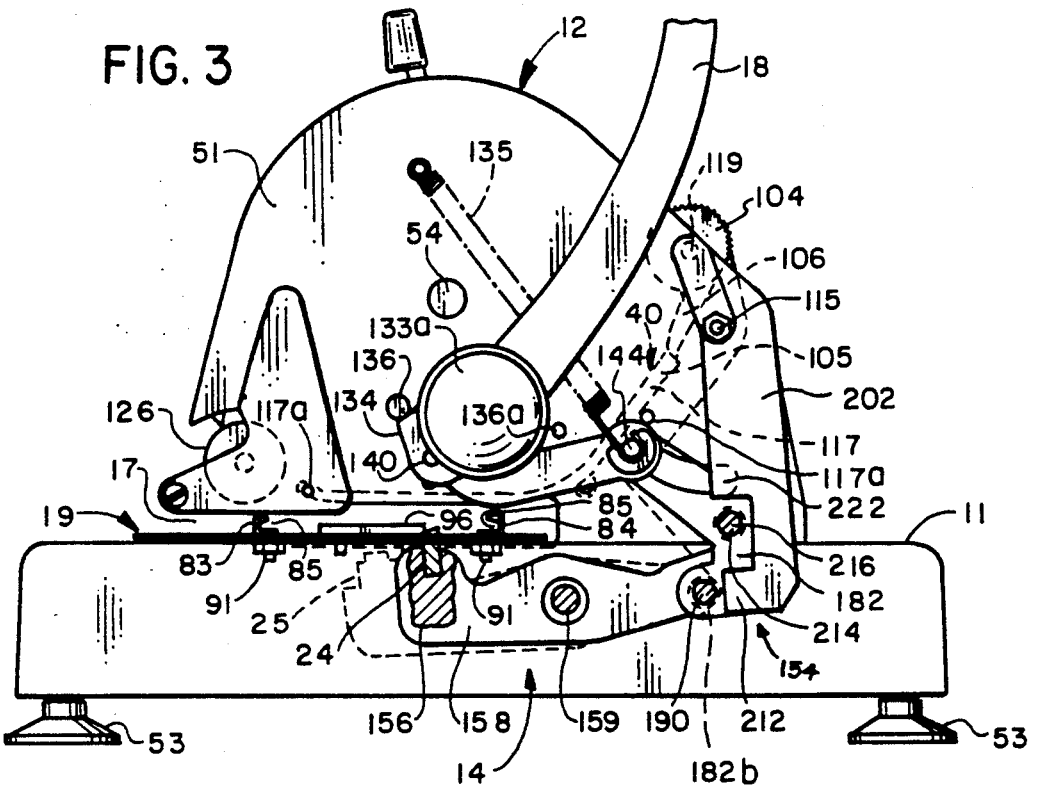
FIG. 3 is a right side elevation view of the imprinting apparatus with the cover removed and partially broken away to illustrate the printing mechanism.

Referring to FIG. 3, guide rail 117, is secured to the inner surface of side plate 51, by lateral projections 117*a* which are recessed in apertures formed in the side plate 51. Guide rail 117 defines an inwardly directed groove 117*b* (FIG. 7B), complementary to groove 116*b*, for locating the cartridge outlet end near the take-up spool. Guide rail 117 terminates just above the print line for the platen 24.

Referring to FIGS. 3, 5 and 7, to replace the ribbon cartridge 40, first the ribbon is rewound onto the supply spool by turning the cartridge knob 125. With all of the ribbon wound to the rear spool, holding the cartridge knob lightly, the operating lever 18 is advanced to reverse the imprinter mechanism to its forward position. Then the cartridge knob is removed from the cartridge, freeing the cartridge from the frame. Then the leading end of the ribbon is removed from the take-up spool. The cartridge 40 can then be drawn up and out from the rear of the unit.

The new cartridge 40 is then inserted into the unit from the rear, the forward end of the cartridge 40 being aligned with the grooves in the guide rails 116, 117 and moved forward until the spool housing 104 drops into its mounting position. At such position, the leading end of the ribbon 41 can be drawn from the cartridge and hooked onto the pins on the take-up spool. The cartridge knob is then replaced. In use, the housing of the imprinter 10 would then be mounted in the base, completing the ribbon cartridge replacement.

Referring to FIGS. 1-3, 3A and 5, the operating lever 18 has a conventional handle portion 18*a* on its outer end and a mounting end 18*b* which is secured in fixed relation to the outer end of a bushing 130 which is rotatably mounted on a stub shaft 131 secured to and projecting outwardly in normal relation from the side plate 51. The operating lever is retained on the bushing through a capnut 133*a* and spring washer (not shown). In this manner, the operating lever 18 may be turned or rotated in a clockwise direction, as viewed in FIG. 2, from a normal rearward non printing position to a forward printing position. A drive link 134 is suitably secured to the bushing in generally normal relation to the axis of rotation of the bushing such that movement of the operating lever effects a corresponding movement of the drive link. The plane of the drive link is spaced outwardly from the outer surface of the side plate 51.

An operating link 138 is pivotally connected at its forward end 138*a* through pivot pin 140 to the lower forward portion 141 of the inner side of drive link 134. The rearward end 138*b* of link 138 is pivotally connected to a cross pintle 144 which forms a part of the printing mechanism, indicated generally at 14. A return spring 135, which is connected between cross pintle 144 and side plate 51 urges the rearward end 138*b* of link 138 forward and upwards, biasing the operating lever 18 towards its non printing position. The travel extent of the operating lever 18 is limited by a stop pins 136 and 136*a* in side plate 51 which are engaged respectively by drive link 134 in its normal or rest position and at the end of the printing stroke.

Referring now to FIGS. 1-3, 3A, 5 and 7, the printing mechanism 14 includes two platen assemblies 151 and 152 and an actuating mechanism, indicated generally at 154. The platen assembly 151 is supported by the upstanding side plates 50 and 51 for movement between a first position spaced from the printing characters positioned on the printing line and a second position in pressure contact with an instrument 30 disposed between the platen 24 and the printing characters positioned on a printing line defined by platen 24. The platen assembly 151 includes a platen support bar 156 suitably mounted at the forward ends of two parallel spaced support arms 157, 158 (only arm 158 is shown in FIG. 3) rockably mounted on a cross shaft 159 extending between and mounted in the base portions of the upstanding side plates 50 and 51. The platen 24 is adjustably mounted on platen bar 156 secured to and between the forward ends of the arms 157, 158.

Figure 3A:
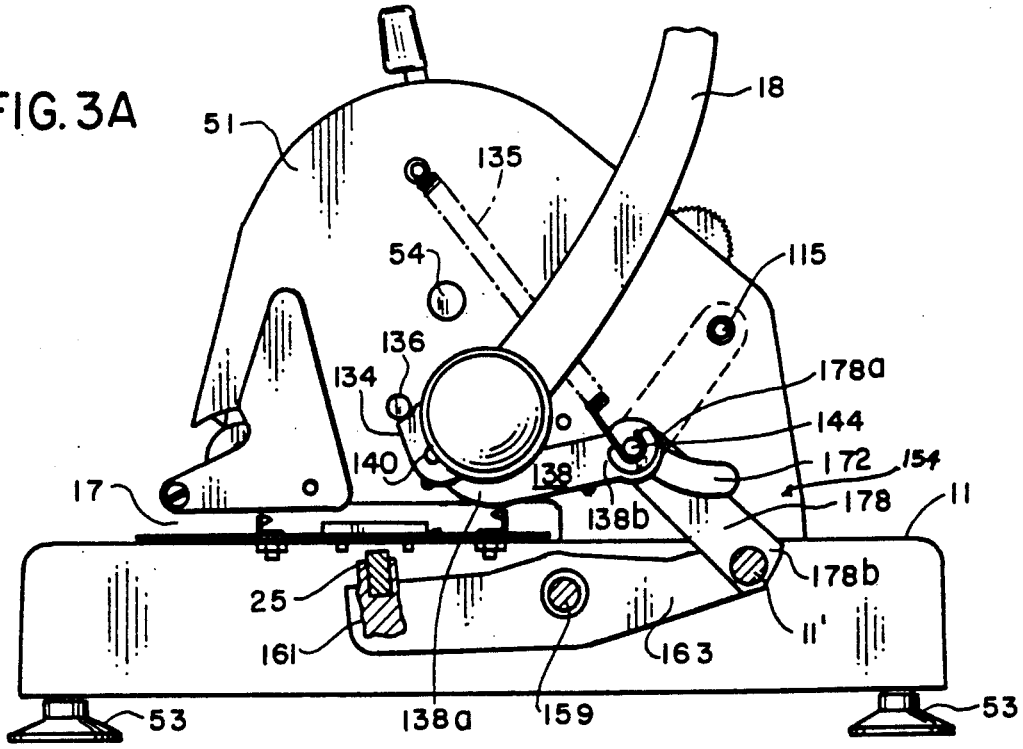
FIG. 3A is a view similar to FIG. 3.

Similarly, platen assembly 152 includes a platen support bar 161 mounted on the forward ends of support arms 162, 163 (only arm 163 of which is shown in FIG. 3A) which are rockably mounted on the cross shaft 159. Platen 25 is adjustably mounted on the platen support bar 161 secured to and between the forward ends of arms 162 and 163.

The actuating mechanism 154 couples the platen assemblies to the operating lever 18 and is operative to effect movement of the platens 24 and 25 to a printing position upon movement of the operating lever 18 from its rearward non-printing position to its forward printing position.

More specifically, the pintle shaft 144 is carried by a toggle yoke 170 and extends transversely of the check writer with opposite end portions being received within arcuate slots 171, 172 (FIGS. 2 and 3A) formed in the upstanding side plates 50 and 51. The toggle yoke 170 is pivotally supported at its upper end by a cross shaft 115 secured to and between the upstanding side plates 50 and 51. The arcuate slots 171, 172 are concentric with the pivot axis of cross shaft to allow rearward pivotal movement of the pintle shaft 144 upon forward and downward movement of the operating handle in a known manner.

A pair of toggle links 176, 178 such as toggle link 178 shown in FIG. 3A, have their upper ends 176*a*, 178*a* pivotally connected to the pintle shaft 144 through elongated slots which provide limited lost motion connections between the toggle links and the pintle shaft. The lower ends 176*b*, 178*b* of links 176 and 178 are pivotally connected to the rearward ends of respective platen support arms 162 and 163.

A further pair of toggle links 180 and 182, such as link 182 shown in FIG. 3, have their upper ends 180*a*, 182*a* pivotally connected to the pintle shaft through elongated slots which provide limited lost motion connections between the links 180, 182 and the shaft 144. The links 180 and 182 have bottom ends 180*b*, 182*b* offset inwardly of their top ends as shown in FIG. 5, defining respective enlarged arcuate mounting portions which are pivotally connected to the rearward ends of the platen support arms 157 and 158, respectively, by way of a cross shaft 190.

The pintle shaft 144 is provided near each end thereof generally adjacent side plate 51 with a circumferential groove (not shown) which receives a lock washer (not shown) for confining the upper end of the corresponding toggle link between the side edge of the toggle yoke 170 and an annular spacer (not shown).

The actuating mechanism includes means, indicated generally at 188, disposed between the pintle shaft 144 in the toggle yoke 170 and the rearward ends of the platen support arms for creating potential energy upon initial movement of the operating lever 18 toward its printing position and releasing the potential energy to selectively effect impact movement of the platen 24 to a printing position upon movement of the operating lever 18 substantially to its printing position. Such means includes three coil compression springs 192 disposed about guide pins 194. The guide pins 194 have lower portions slidably received through suitable bores in cross shaft 190. The cross shaft 190 has reduced end portions 198 received within apertures in the corresponding rearward ends of the platen support arms 157, 158 in a manner to allow rotation of the cross shaft 190 relative to the platen support arms. The guide pins 194 are supported in normal relation to the longitudinal axis of the cross shaft 190 and have upper end portions suitably secured to the toggle yoke 170 which supports the pintle shaft 144. The coil compression springs are selected such that their lengths and spring rates are sufficient when the springs are assembled between the yoke head and the cross shaft 190, to continually urge the head yoke against the pintle shaft 144.

The actuating mechanism further includes a pair of holding or control links 202 pivotally supported by shafts 115. Referring to FIGS. 3 and 5, each of the control links 202 includes two parallel members 203 and 204 which have their upper ends spaced apart a distance corresponding to the width of the mounting portions of the toggle yoke 170, allowing the ends to straddle the yoke mounting ends. The outer member 203 has its lower end offset inwardly to be joined with the lower end of the companion member 204. Each of the control links includes an upper arm portion 208 to which is attached a tension coil spring 210. The tension springs have their opposite ends attached to the corresponding side plates 50 and 51 as through an end portion of each spring being received in an aperture in a projection (not shown) on the inner wall of the corresponding side plate. The tension springs 210 urge the corresponding control links 202 in clockwise directions about their pivot axes as considered in FIG. 3. Each of the control links 202 includes a lower hook portion 212 adapted to underlying a roller or annular sleeve 214 suitably supported on cross shaft 216 which is secured to and between the rearward end portions of the platen support arms 157 and 158. The cross shaft 216 has reduced end portions which form shoulders which abut the inner surfaces of the platen support arms 157, 158 to maintain them in spaced relation. Annular sleeves are received over the reduced diameter end portions of the cross shaft and serve to maintain the corresponding rollers 214 in outward spaced relation from the associated platen support arms. Means such as snap rings 220 are provided on the outermost ends of the shaft end portions to maintain the associated rollers 214 thereon.

The control links 202 have profile configurations such that when the control links 202 are positioned in their extreme counterclockwise positions with the arm portions abutting the stops, a forward lower edge portion 222 will be spaced rearwardly from the corresponding roller 214. The forward edge portion 222 of each of the control links 202 overlies the corresponding arcuate slot 171, 172 adjacent the inner surface of the associated upstanding side plates 50 and 51 so as to be in the path of travel of the corresponding outer end portion of the pintle shaft 144 when the pintle shaft is moved substantially its full rearward path of travel within the elongated slots.

Figure 14:
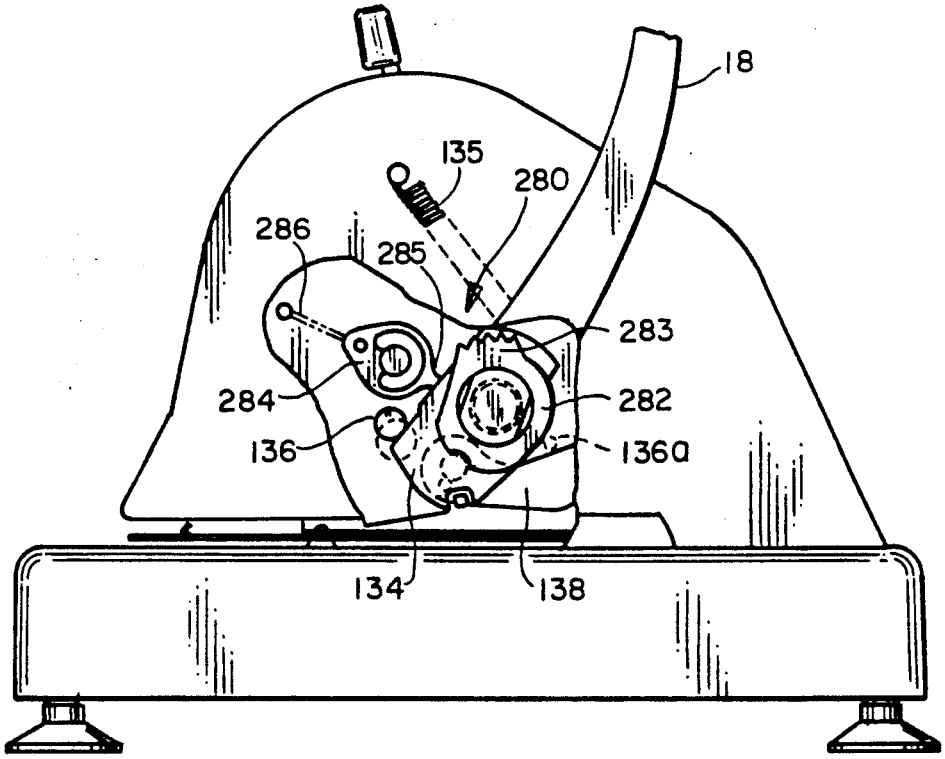
FIG. 14 is an enlarged fragmentary view illustrating the operating lever ratchet mechanism.

Referring to FIG. 14, the purpose of insuring that the operating lever 18 is moved completely through its printing stroke i.e., that member 134 is pivoted to engage stop pin 136*a*, there is provided an operating lever ratchet mechanism 280. The operating lever ratchet mechanism 280 includes a cam 282 with teeth 283, and a pawl 284. The cam 282 is connected to drive link 134 and rotatable therewith with operation of the operating lever 18 between its non-printing and printing positions. The pawl 284 is rotatably mounted on side plate 51 with a finger portion 285 positioned to be engaged by the cam teeth 283 as cam 282 rotates counterclockwise as viewed in FIG. 14, rotating pawl 284 clockwise against the force of spring 286. This mechanism insures that during a printing operation, the operator will continue moving the operating lever 18 toward its printing position after hearing the sound made by the impacting platen mechanism 151, so that the pressure platen mechanism 152 is moved into firm pressure contact with the print characters to imprint the serrated dollar amount in field 34.

Figure 2:
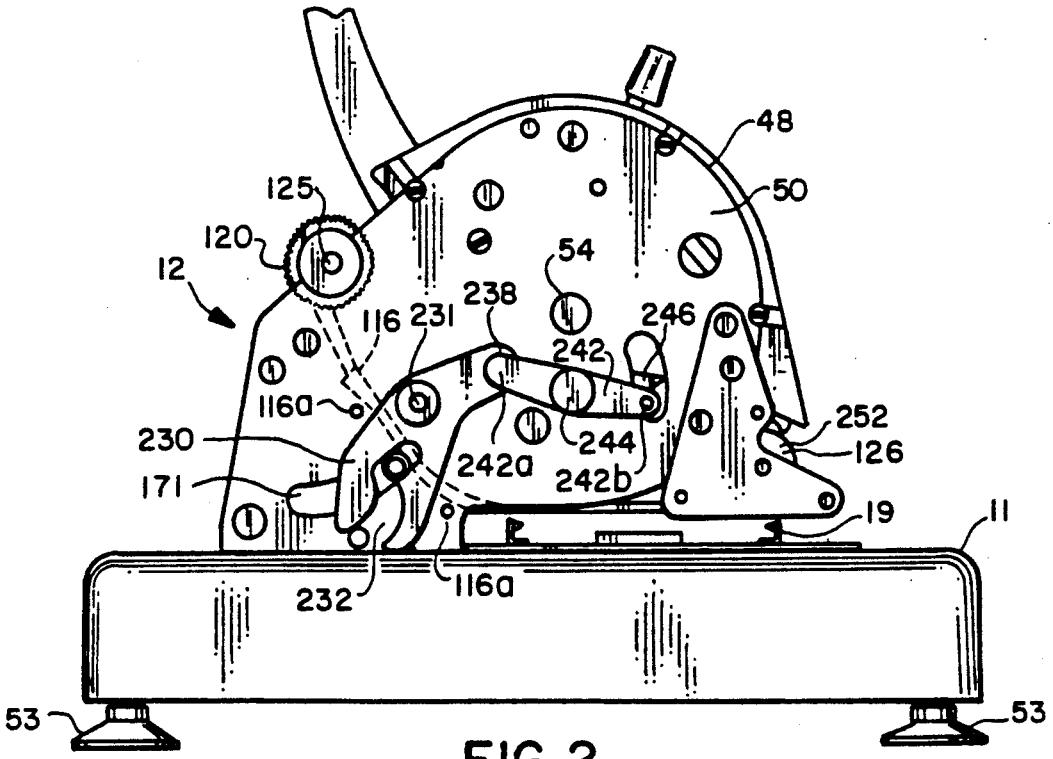
FIG. 2 is a left side elevation view of the imprinting apparatus with the cover removed.

Referring to FIGS. 2 and 5, for the purpose of advancing the inked ribbon 41 with each printing operation, there is provided a follower link 230 which is pivotally mounted on the outer surface of said wall 50 by a pivot member 231. The follower link 230 defines a generally L-shaped slot 232 which extends rearwardly and then downwardly from a point near the pivotal attachment of link 230 to the side wall 50, and adjacent to the arcuate slot 171 which defines the path of travel for the pintle shaft 144. The follower link 230 is pivoted clockwise, as viewed in FIG. 2, by and as the pintle shaft 144 is driven rearwardly during a printing cycle.

Figure 15:
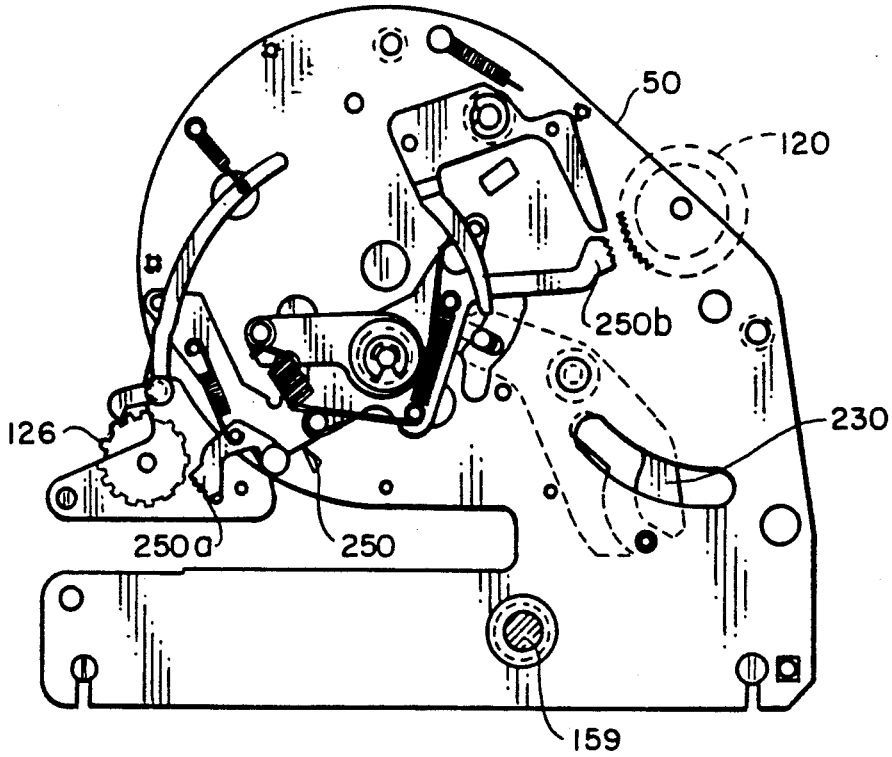
FIG. 15 is an enlarged fragmentary view taken along the line 15—15 of FIG. 5, illustrating the ribbon reverse mechanism.

The forward end 238 of the follower link 230 is pivotally connected to one end 242*a* of a toggle link 242 which is pivotally mounted on the side plate 50 by pivot member 244. The other end 242*b* of the toggle link 242 is pivotally connected to a toggle link 246 which is pivotally mounted in the inner surface of side plate 50 and which couples a toothed drive member 250 (FIG. 15) to drive gear 252 (FIG. 7) of the take-up spool 126 and a toothed drive member 250*a* to the drive gear 120 of the cartridge spool 104 (FIG. 9). Upon reaching maximum front or rear directional tension resistance, the member 250 reverses to the opposite direction of travel to engage either the drive gear 120 of the cartridge or the drive gear 120 of the take-up spool. Reversal ribbon drive mechanism of the type are known in the art. The checkwriter apparatus may include a clear mechanism (not shown) to reset the printing segments to zero settings automatically at the end of each printing stroke as is known in the art.

Referring to FIGS. 1,5 and 7 in conjunction with FIGS. 16–19 which illustrate the relative positions of operating lever 18, and platen assembly during a printing cycle, the operation of checkwriter 10 will now be briefly described.

First, the user sets the print segment members 21 and 22 to the appropriate positions to provide printing of the current date and the dollar amount for which the check or money order is to be drawn. It is assumed that print segment members 23 have been preset to provide the proper source identification information to be imprinted on the form. The form 30 is then inserted into the form guide 19 until the forward end of the form engages the stop member.

Reference is now made to FIGS. 16–19 in conjunction with FIGS. 3, 5 and 7, for the operation of the platen assemblies 151 and 152 in effecting corresponding upward movement of the platens 24 and 25 during printing of an instrument 30 disposed within the form guide 19 of the checkwriter.

Figure 16:
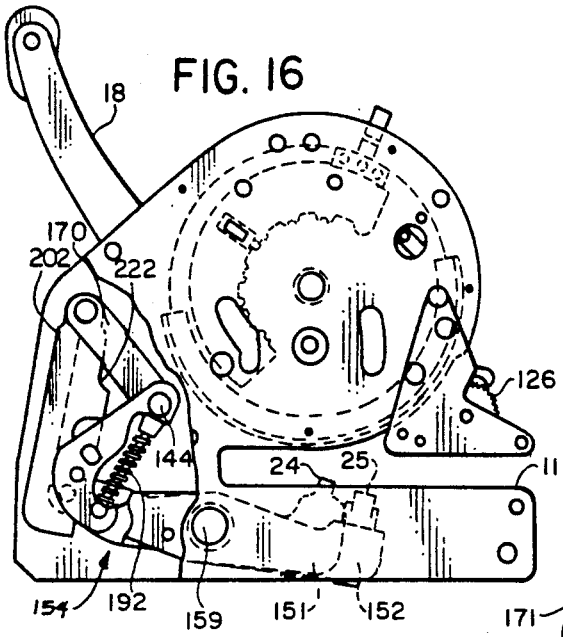
FIG. 16 is a simplified side elevational view illustrating the imprinting apparatus in its idle or non-imprinting condition.

In the non-printing position (FIG. 16), return spring 135 biases pintle 144 forwardly whereby the toggle yoke 170 raises the rearward ends of the platen support arms maintaining their forward ends and the platens 24 and 25 carried thereby in a downward non printing position (FIG. 16). In the non printing position, the compression springs 192 of the potential energy creating means are in generally extended, but slightly compressed states.

Initial movement of the operating lever 18 toward a forward printing position rotates the drive link 134 clockwise driving the operating link 138 rearwardly.

Figure 17:
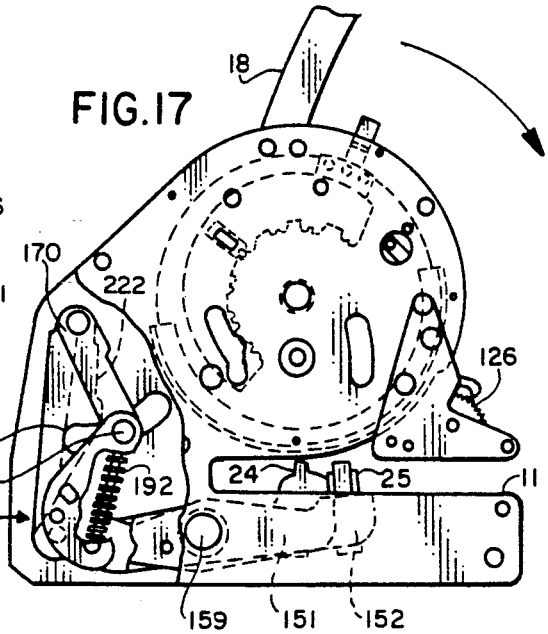
FIG. 17 is a view similar to FIG. 16, but illustrates the operating lever moved partly toward its imprinting position.
Figure 18:
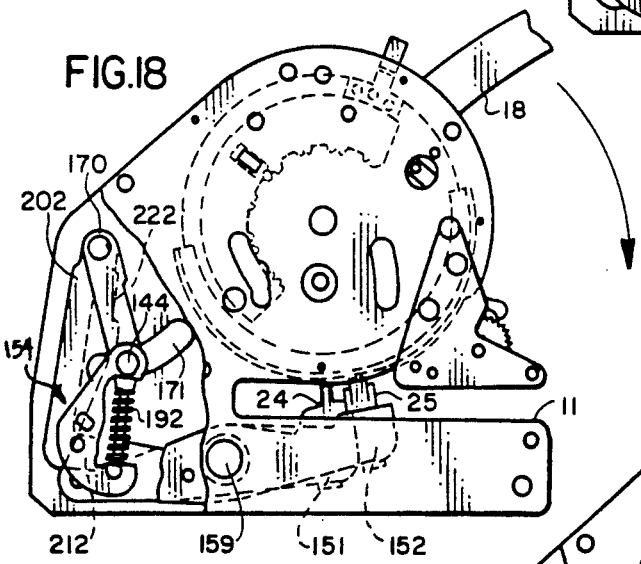
FIG. 18 is a view similar to FIG. 16, but shows the operating lever moved a further distance toward its imprinting position.

As the operating lever 18 is moved forwardly to the position illustrated in FIG. 17, the operating link 138 effects rearward movement of the pintle shaft 144 within the arcuate slots 171, 172. Such rearward movement of the pintle shaft 144 begins to drive the toggle links 176, 178 and 180, 182 rearwardly and downwardly. As noted above, the elongated slots in the links provide lost motion for the pintle shaft 144 during initial rearward movement of the pintle shaft and therefore do not initially effect pivotal movement of the links about their pivot axis.

As the pintle shaft 144 is moved further rearwardly within the arcuate slots 171, 172 upon continued forward movement of the operating lever 18, the toggle links effect downward or counter-clockwise rotation of the platen support arms about their pivot axis, as viewed in FIG. 17, to raise their forward ends above their initial or non-printing positions. Such movement of the inner platen support arms 157, 158 of platen assembly 151 is limited through engagement of the rollers with the hook portions 212 of the control links 202. After the rollers 214 have engaged the hook portions 212 of the control links 202, the compression springs 192 begin to be compressed with a corresponding increase in the potential energy created therein.

However, as the cross pintle 144 is driven rearwardly, the links 168 and 169 are driven downwardly and rearwardly, pivoting the platen support arms 162 and 163 of platen assembly 152 counterclockwise, as viewed in FIG. 17, pivoting the platen 25 upwardly.

With further rearward movement of the operating lever 18 toward the position illustrated in FIG. 19, the outer end portions of the pintle shaft 144 engage the forward edge portions 222 of the control links 202 and move the control links in a counterclockwise direction, as viewed in FIG. 3, to release the hook portions 212 from below the rollers 214 on the platen control arms. The configuration of the control links 202 is such that the control links are not released from their positions underlying the rollers 214 until the compression springs 192 have been substantially compressed.

Figure 19:
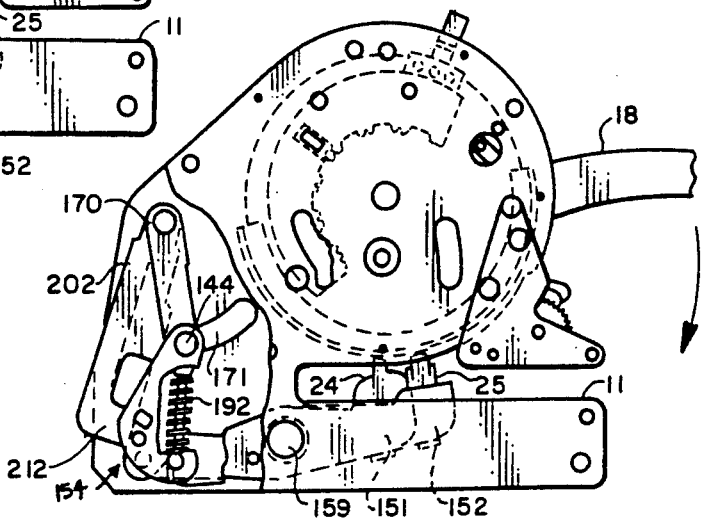
FIG. 19 is a view similar to FIG. 16, but illustrates the operating lever in its imprinting position.

Thereafter, further rearward movement of the pintle shaft 144 through completion of forward movement of the operating lever to the position illustrated in FIG. 19 (with member 134 engaging stop 136*a*, FIG. 3) will effect release of the control links 202 from their underlying positions relative to the rollers 214 and allow the compression springs 192 to release their potential energy in an expansion movement and effect downward movement of the rearward ends of the platen support arms 162 and 163 whereby to effect upward impact movement of the platen 24 into pressure contact with a form located in the checkwriter. Pressure contact of the platen 24 against the under surface of the blank instrument effects printing on the upper surface of the instrument through the printing characters positioned on the printing line of the checkwriter defined by platen 24.

Also, when the operating lever 18 reaches its printing position, illustrated in FIG. 19, the platen 25 is driven into pressure contact with the inked ribbon, the form and the type characters disposed on the print line such that its serrated print head perforates the form while imprinting the dollar and cents amount on the form 30 in field 34 thereof. In addition, the linkage including follower link 230 (FIG. 2) and toggle link 244 advances the inked ribbon 41 by driving the ribbon take-up spool.

Upon such impact movement of the platen 24 into pressure contact with the blank instrument 30 to effect printing thereon and release of the operating lever by the user, the operating lever 18 is moved upwardly and rearwardly, returing to its non printing position, shown in FIG. 16, under the force of restoring spring 135. Such rearward movement of the operating lever causes the pintle shaft 144 to be returned to its initial position within the arcuate slots with simultaneous counterclockwise movement of both sets of the platen support arms 157, 158 and 162, 163 about their pivot axis due to the toggle links 176, 178 and 180, 182, effecting counterclockwise pivotal movement of the links to force the forward ends of the platen support arms downwardly. With the pintle shaft 144 being returned to its normal non printing position in the arcuate slots, the tension springs return the control links to their normal positions preparatory to a subsequent printing operation.

We claim:

1. An inked ribbon cartridge for use with an apparatus for imprinting an instrument, comprising:

a ribbon, a spool and a housing including a first housing member and a second housing member constructed and arranged to be assembled together enclosing said ribbon and said spool therewithin, said first and second housing members when assembled together defining a spool receiving chamber, a ribbon guide portion and a throat portion communicating said chamber with said ribbon guide portion, said first housing member having a first flat panel portion and said second housing member having a second flat panel portion overlying said first panel portion to provide said ribbon guide portion, said ribbon being adapted for advancement bidirectionally through said ribbon guide portion between said first and second panel portions thereof, said first panel portion having first and second windows therethrough and said second panel portion having first and second windows therethrough and aligned with said first and second windows in said first panel portion exposing therethrough first and second portions of said ribbon as said ribbon is advanced through said ribbon guide portion.

2. An inked ribbon cartridge according to claim 1, wherein said ribbon includes a first portion aligned with said first window and bearing a pigment-based ink, and a second portion adjacent to said first portion and aligned with said second window and bearing a dye-based ink.

3. An inked ribbon cartridge according to claim 2, and further comprising means separating said first and second portions of said ribbon to prevent migration of said dye-based ink from said second portion to said first portion of said ribbon.

4. An inked ribbon cartridge according to claim 2, including a heat sealed seam formed longitudinally of said ribbon separating said first and second portions to prevent migration of said dye-based ink from said second portion to said first portion of said ribbon.

5. An inked ribbon cartridge according to claim 2, wherein said dye based ink is located to imprint preselected information onto an instrument.

6. An inked ribbon cartridge according to claim 1, wherein said ribbon includes a first portion aligned with said first window and bearing a dye-based ink, and a second portion adjacent to said first portion and aligned with said second window and bearing a dye-based ink.

7. An inked ribbon cartridge for use with an imprinting apparatus for imprinting an instrument, the imprinting apparatus including a plurality of type segments each having a plurality of printing characters, said type segments being movable to locate selected printing characters thereof on at least one printing line, and platen means adapted for cooperation with the selected printing characters during imprinting operations, said cartridge comprising: a spool, an inked ribbon wound on the spool, said ribbon having first and second sides and a free end portion, and a housing including a first housing member and a second housing member constructed and arranged to be assembled together enclosing said ribbon and said spool therewithin, said first and second housing members when assembled together defining a spool receiving chamber, a ribbon guide portion and a throat portion communicating said spool receiving chamber with said ribbon guide portion, said first housing member having a first flat panel portion and said second housing member having a second flat panel portion overlying said first panel portion to provide said ribbon guide portion which is located between said type segments and said platen means in use, said spool being rotatably mounted within said chamber to permit said ribbon to be drawn off said spool and rewound onto said spool for providing advancement of said ribbon bidirectionally through said ribbon guide portion between said first and second panel portions thereof, said first panel portion having first and second windows therethrough and said second panel portion having first and second windows therethrough and aligned with said first and second windows in said first panel portion exposing therethrough first and second portions of said ribbon at both sides thereof as said ribbon is advanced through said ribbon guide portion.

8. An inked ribbon cartridge for use with an imprinting apparatus for imprinting an instrument, the imprinting apparatus including a plurality of type segments each having a plurality of printing characters, said type segments being movable to locate selected printing characters thereof on at least one printing line, and platen means adapted for cooperation with the selected printing characters during imprinting operations, said cartridge comprising: a spool, an inked ribbon wound on the spool, said ribbon having first and second sides and a free end portion, and a housing including a first housing member and a second housing member constructed and arranged to be assembled together enclosing said ribbon and said spool therewithin, said first and second housing members when assembled together defining a spool receiving chamber, a ribbon guide portion and a throat portion communicating said spool receiving chamber with said ribbon guide portion, said first housing member having a first flat panel portion and said second housing member having a second flat panel portion overlying said first panel portion to provide said ribbon guide portion which is located between said type segments and said platen means in use, said spool being rotatably mounted within said chamber to permit said ribbon to be drawn off said spool and said spool having a drive portion accessible externally of said cartridge to permit said ribbon to be rewound onto said spool thereby providing advancement of said ribbon bidirectionally through said ribbon guide portion between said first and second panel portions thereof, said first panel portion having first and second windows therethrough and said second panel portion having first and second windows therethrough and aligned with said first and second windows in said first panel portion exposing therethrough first and second portions of said ribbon at both sides thereof as said ribbon is advanced through said ribbon guide portion.

* * * * *